United States Patent [19]

Souma

[11] 4,010,288

[45] Mar. 1, 1977

[54] METHOD OF PREVENTING EVAPORATION OF LIQUID ON AN IMAGE-BEARING MEMBER

[75] Inventor: Ikuo Souma, Yokohama, Japan

[73] Assignee: Canon Kabushiki Kaisha, Tokyo, Japan

[22] Filed: Sept. 19, 1975

[21] Appl. No.: 614,962

[30] Foreign Application Priority Data

Oct. 4, 1974 Japan ..... 49-114367
Oct. 4, 1974 Japan ..... 49-114368

[52] U.S. Cl. ..... 427/15; 427/16
[51] Int. Cl.[2] ..... B05D 3/00; B05D 1/26
[58] Field of Search ..... 427/15, 16; 118/7

[56] References Cited

UNITED STATES PATENTS

| | | | |
|---|---|---|---|
| 3,368,525 | 2/1968 | Sacre | 118/7 X |
| 3,752,119 | 8/1973 | Matkan | 427/15 X |
| 3,759,220 | 9/1973 | Saito et al. | 427/15 X |

*Primary Examiner*—James R. Hoffman
*Attorney, Agent, or Firm*—Fitzpatrick, Cella, Harper & Scinto

[57] ABSTRACT

Evaporation of an evaporative liquid on an image-bearing member bearing thereon an electrostatic latent image or a visualized image may be prevented by removing the evaporative liquid before the image-bearing member is stopped, thereby preventing the liquid from evaporating from the surface of the image-bearing member during stoppage thereof.

10 Claims, 9 Drawing Figures

METHOD OF PREVENTING EVAPORATION OF LIQUID ON AN IMAGE-BEARING MEMBER

BACKGROUND OF THE INVENTION

1. Field of the Invention

This invention relates to a method of preventing evaporation of evaporative liquid used with an image forming apparatus, and more particularly to a method of preventing evaporation of such liquid on an image-bearing member in an image forming apparatus using electrophotography.

2. Description of the Prior Art

Description of the prior art will hereinafter be made by taking an electrophotographic copying apparatus and developing liquid as examples of the image forming apparatus and the evaporative liquid, respectively. Development of a latent image electrophotographically formed on a photosensitive medium or a latent image on an insulating member which is a recording medium has been effected by the use of toner dispersed in highly insulative carrier liquid. The carrier liquid used in the developing liquid has usually been an insulating liquid belonging to the petroleum family and such liquid will naturally evaporate if it is exposed to the atmosphere. As a result, the balance between the carrier liquid and the toner forming the developing liquid will be destroyed rendering the concentration of the developing liquid unstable, and thus making it impossible to obtain the desired effect of development. Also, if the developing liquid contains therein a control agent, the balance between the toner and the control agent in the developing liquid will become readily disrupted and this will again make it impossible to produce the desired effect of development. Further, some types of carrier liquid emit offensive odors which are unpleasant to the operator of the apparatus. On the other hand, inadvertent loss of the carrier liquid during non-use thereof will mean an economical disadvantage.

To overcome the above-noted disadvantages and problems, there have heretofore been invented various methods for the prevention of evaporation in the container for developing liquid. However, how to prevent evaporation of developing liquid on a photosensitive medium or a recording medium formed of an insulative member (for example, an insulative belt or drum) has still been left to be solved.

SUMMARY OF THE INVENTION

It is a primary object of the present invention to prevent evaporation of evaporative liquid on an image-bearing member such as a photosensitive medium or an insulative member bearing thereon a latent image or a member bearing thereon a visualized image, thereby solving the above-noted problems existing in the prior art. The term "evaporative liquid" used herein refers to developing liquid for visualizing latent images, cleaning liquid for cleaning the visualized images, etc.

It is another object of the present invention to prevent the liquid, if it is developing liquid, from evaporating from the image-bearing member and enhance the cleaning efficiency for the image-bearing member.

It is still another object of the present invention to enable a liquid evaporation preventing member on the image-bearing member to serve also as a member used for the image formation process, if the liquid is developing liquid, thereby simplifying the construction of the apparatus.

Other objects and effects of the present invention will appear in the following detailed description of the invention taken in conjunction with the accompanying drawings.

The present invention provides a method of preventing inadvertent evaporation of evaporative liquid on an image-bearing member by eliminating the liquid on the image-bearing member before it is stopped.

The present invention also provides such a method of preventing evaporation of the liquid on the image-bearing member wherein the contact or supply of the liquid, which acts on the image-bearing member, to this member is cut off before it is stopped.

The present invention further provides such a method of preventing evaporation of the liquid wherein the liquid on the image-bearing member is positively removed before the image forming member is stopped.

BRIEF DESCRIPTION OF THE DRAWINGS

FIG. 2 showing an embodiment of the present invention having a mechanism for clogging the liquid intake port of a pump;

FIG. 3 showing an embodiment of the present invention having a mechanism for cutting off the liquid supply with the image-bearing member and the liquid supply means spaced apart from each other;

FIG. 4 illustrating a mechanism for spacing the image-bearing member and the liquid supply means apart from each other;

FIG. 5 showing an embodiment of the present invention having a mechanism for positively removing the liquid on the image-bearing member;

FIG. 6 showing a modification of the FIG. 5 embodiment in which the liquid is removed by a roller;

FIG. 7 being a fragmentary illustration of a further modification in which the liquid is removed by injecting compressed air thereagainst;

FIG. 8 showing an embodiment of the present invention having a mechanism whereby the liquid removal means of the present invention is operatively associated with cleaning means for the image-bearing member; and FIG. 9 showing an embodiment of the present invention provided with the embodiments illustrated with reference to FIGS. 1 and 5.

DESCRIPTION OF THE PREFERRED EMBODIMENTS

The present invention which prevents unnecessary evaporation of liquid by eliminating the liquid from the surface of an image-bearing member prior to the stoppage thereof will hereinafter be described with respect to an embodiment thereof and in conjunction with the drawings thereof. According to the present invention, the elimination of liquid from the surface of the image-bearing member may be accomplished by any of two methods. A first method is to cut off the contact of the liquid acting on the image-bearing member with this member prior to the stoppage thereof. A second method is to positively remove the liquid on the image-bearing member prior to the stoppage thereof. These methods of the present invention will first be discussed with respect to a drum-shaped photosensitive medium applied to the liquid developing method.

Figure 1:
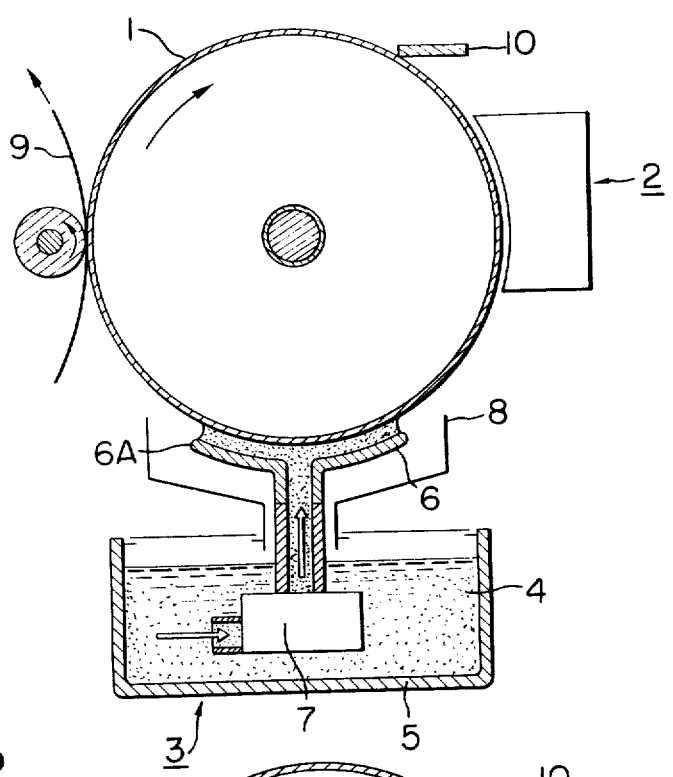
FIG. 1 is a schematic sectional view of a conventional electrophotographic copying apparatus.

FIG. 1 schematically shows a cross-section of a conventional electrophotographic copying apparatus. Reference numeral 1 designates a drum-shaped photosensitive medium formed of a conductive layer, a photoconductive layer and further, an insulating layer and having a surface width of 300 mm and a diameter of 160 mm. The photosensitive medium is rotatable at a velocity of 120 mm/sec. in the direction of the arrow. Electrostatic latent image forming means 2 is disposed circumferentially of the photosensitive medium 1 and includes a corona charger and an optical system. Designated by 3 is developing means for developing the latent image formed by the latent image forming means 2, by the use of developing liquid consisting chiefly of toner and carrier liquid including a highly insulative liquid such as ISOPAR (tradename of the product of Exxon U.S.A Inc.). The developing means 3 includes a container for developing liquid 4, a developing dish 6 acting as a developing electrode, a pump 7 for supplying the developing liquid 4 into the developing dish 6, and a receptacle dish 8 for receiving an overflow of developing liquid from the developing dish 6 and for redirecting the overflow into the container 5. Once photosensitive medium 1 passes developing means 3, it transfers the toner image thereon onto transfer paper 9. After completion of the image transfer, the photosensitive medium 1 undergoes the cleaning effected by a blade 10 which removes any excess developing liquid on the surface of the photosensitive medium in preparation for a subsequent copy cycle. In the conventional copying apparatus as described, if the blade 10 is disposed so that the cleaning end thereof lies at a point on the photosensitive medium which is diametrically opposite to the end 6A of the developing dish 6, when the photosensitive medium 1 is stopped after completion of a predetermined copy cycle, there will remain a layer of developing liquid as thick as about 20 to 30 microns on the surface of the photosensitive medium between the end 6A of the developing dish and the blade 10, it being understood that the above-mentioned thickness of the developing liquid layer has been calculated for the temperature 25° C of the developing liquid. For the disclosed photosensitive medium, the amount of such developing liquid layer thereon corresponds to 1.5 to 2.3 cc and, if the photosensitive medium is left stationary under such conditions for several minutes, only the carrier liquid in the developing liquid would naturally evaporate up. If such evaporation of the carrier liquid took place repetitively each time the photosensitive medium was stopped, the amount of the evaporation would reach a significant level. More specifically, if the photosensitive medium was stopped 50 times per day and left stationary for 5 or more minutes each time, then the amount of the evaporation would come to about 100 cc per day or 2 liters or more per month. Such evaporation of the carrier liquid alone would give rise to the various problems noted above, and the inventors have found that the following method is effective to prevent the natural evaporation of evaporative liquid from the surface of an image-bearing member such as a photosensitive medium or the like.

The method comprises cutting off the contact between the photosensitive medium 1 and the developing liquid 4 after the developed image on the photosensitive medium required to be transferred has passed the developing dish 6 in the developing means 3 of FIG. 1 but before the photosensitive medium 1 is stopped. As the specific means therefor, it would especially be effective (1) to discontinue the supply of the developing liquid to the developing dish and (2) to space the developing dish 6 from the photosensitive medium 1 to thereby cut off the contact between the developing liquid 4 on the developing dish 6 and the photosensitive medium 1.

Figure 2:
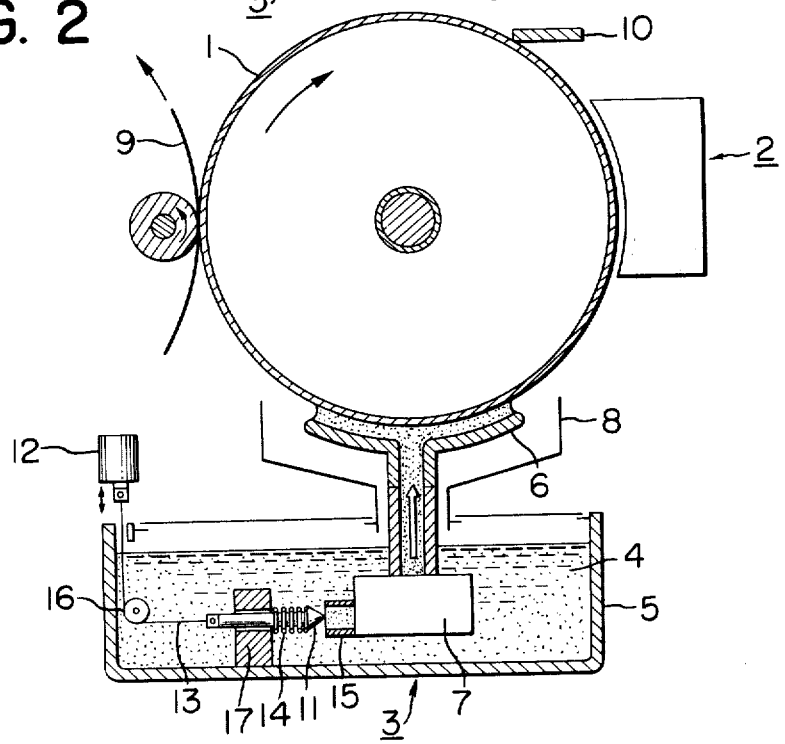
FIGS. 2 to 9 are schematic sectional views of a copying apparatus in which the present invention is applied to the developing means.

Considering the above-described embodiment with reference to FIG. 1, the pump 7 in the developing means 3 may be utilized as the means (1) mentioned above. More specifically, this may be accomplished by stopping or reversing the revolution of the motor of the pump or by reversing the direction of liquid supply of the pump 7 by the use of clutch or like means. As a further alternative, the developing liquid supplied to the developing dish 6 in FIG. 1 may be discontinued by clogging the liquid intake port of the pump 7, and an example of the mechanism thereof is shown in FIG. 2. In FIG. 2, a valve 11 may clog or unclog the liquid intake port 15 of the pump 7 with the aid of a solenoid 12, a wire 13 connecting the solenoid 2 to the valve 11, and a spring 14. In FIG. 12, the developing means 3 is shown to be in a position in which it is developing the latent image on the photosensitive medium 1, with the valve 11 biased rightwardly against the force of the spring 14 by the solenoid 12 and the wire 13. When the photosensitive medium 1 is stopped, the solenoid 12 is energized to force the valve 14 leftwardly to clog the liquid intake port 15. When the supply of the developing liquid into the pump is thus cut off, the developing liquid on the developing dish 6 in FIG. 1 will only overflow from the opposite sides of the dish without any additional supply of developing liquid, so that the developing dish 6 will soon become empty. Reference numeral 16 designates a pulley for changing the direction of movement of the wire 13, and reference numeral 17 denotes a fixed guide member for controlling the direction of movement of the valve 11.

However, cutting off the supply of the developing liquid to the pump as described is not the only possible means but other means are also possible such as changing the direction of flow of the liquid on its way from the pump 7 to the developing dish 6, or forming the developing dish 6 with a number of openings which are adapted to be closed during development but to be opened, when the photosensitive medium is stopped, to thereby permit a greater quantity of developing liquid than that supplied to escape through the openings.

Figure 3:
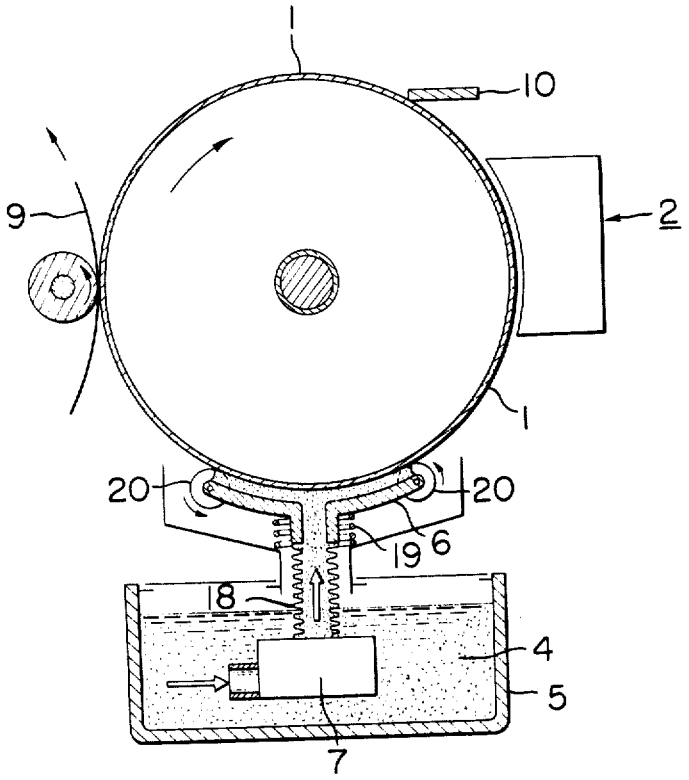
Figure 4:
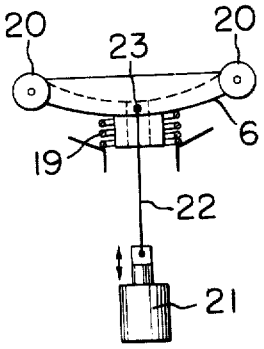

As the means (2) mentioned above, the developing dish 6 and the pump 7 may be interconnected by a flexible pipe 18 while the developing dish 6 may be raised by a spring 19, in the manner as shown in FIG. 3. The width of the clearance between the photosensitive medium 1 and the developing dish 6 is determined by the contact between the photosensitive medium 1 and positioning rollers 20 provided at the opposite ends of the developing dish 6. Also, as shown in FIG. 4, one or both of the opposite ends of the developing dish 6 may be provided with a retaining portion or portions 23 for retaining one end of a wire 22 connected to the solenoid 21. When the photosensitive medium 1 is stopped, the solenoid 21 may be energized to pull on the wire 22 to thereby pull down the developing dish 6 with respect to the photosensitive medium 1, thus cutting off the contact between the photosensitive medium 1 and the developing liquid on the developing dish 6.

The above-described embodiment shows the method of preventing natural evaporation of the liquid on an image-bearing member such as photosensitive medium or the like by cutting off the contact or the supply of the liquid, which has so far acted on the image-bearing member before stopped from rotating, thereby eliminating the presence of the liquid from the image-bearing member in its stationary condition.

As a second embodiment of the present invention, a method of positively removing the liquid from the image-bearing member by the use of liquid removal means will now be described by way of example. In the embodiment shown in FIG. 5, liquid removal means 24 comprising a blade 26 of elastic material such as polyurethane or the like pivotable about a shaft 25 is disposed between the toner image transfer station and the developing station but adjacent to the latter station. During rotation of the photosensitive medium 1, the removal means 24 assumes the phantomline position in which it makes no contact with the photosensitive medium 1. However, in case of the stoppage of the photosensitive medium, after the trailing end of the necessary toner image on the photosensitive medium has passed the image transfer station, the blade 26 is pivoted from the phantom-line position to the solid-line position by rotating the shaft 25, thereby removing the unnecessary developing liquid on the photosensitive medium 1. By this, the presence of the developing liquid is eliminated on the photosensitive medium between the blade 26 and the blade 10 and thus, even where the photosensitive medium is in its stationary condition, it is possible to prevent unnecessary evaporation of carrier or like liquid which is apt to evaporate from the surface of the photosensitive medium. Another embodiment of the method of positively removing the developing liquid from the photosensitive medium 1 will hereinafter be described with reference to FIGS. 6 and 7.

Figure 5:
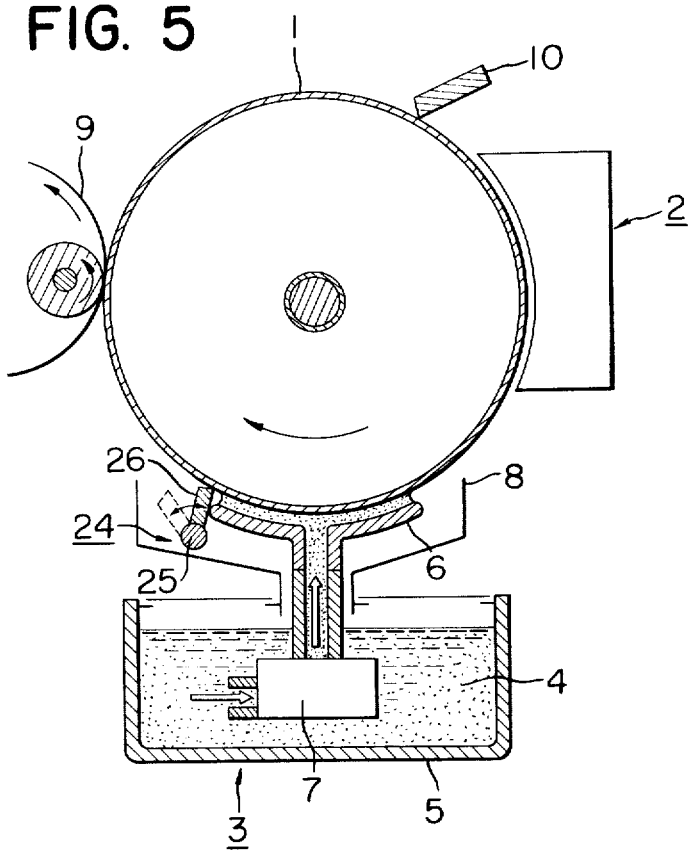
Figure 6:
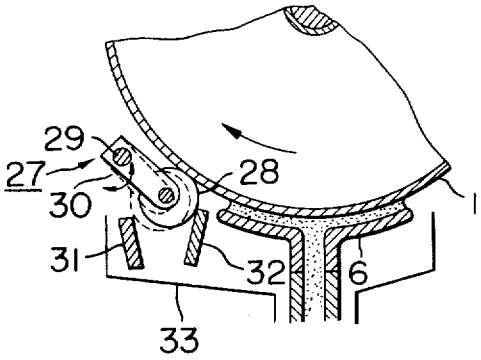

The liquid removal means 27 of FIG. 6 is an example of the removal means which employs a liquid control roller for controlling the thickness of the liquid layer adhering to the photosensitive medium. The means 27 includes a liquid control roller 28, a pivot shaft 29 for pivotally supporting the roller 28 thereon, an arm member 30, blades 31 and 32 engageable with the roller 28, and a receptacle dish 33 for removed developing liquid. In the device of the present embodiment, the roller 28 assumes the phantom-line position to act as the liquid control roller during normal copying operation, but it pivotally moves to the solid-line position when it is to remove the developing liquid on the photosensitive medium 1, as already described in connection with the embodiment of FIG. 5. The roller 28 is rotatable clockwise or counter-clockwise, and the direction of rotation thereof is restricted in no way in the present invention.

Figure 7:
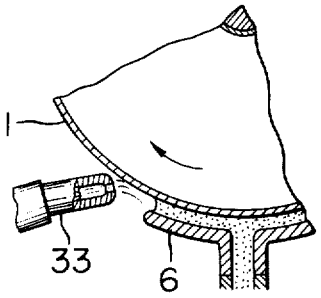

FIG. 7 shows an embodiment in which compressed air injected through a nozzle 33 is utilized as the means for removing the developing liquid on the photosensitive medium 1. The timing of the operation thereof is similar to that in the embodiment of FIG. 5. The utilization of compressed air for the removal of the liquid as in the present embodiment is preferable in that the photosensitive medium is free of any damage imparted by friction, but it is necessary that the compressed air in use be at a temperature which will never induce evaporation of the developing liquid.

Figure 8:
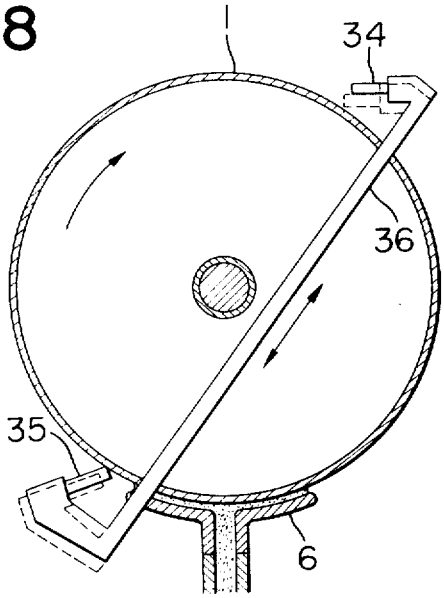

FIG. 8 shows an embodiment which employs blades as the liquid removal means, but the blades, unlike the blade in the FIG. 5 embodiment, are not pivotable but movable in parallel. More specifically, the present embodiment includes a first blade 34 and a second blade 35 which are each secured to an arm member 36 and movable in the direction of double-headed arrow by an electromagnetic plunger or like means. Thus, during normal copying operation, the first blade 34 in the phantom-line position effects the cleaning of the photosensitive medium 1, but in case of the stoppage of the photosensitive medium, the arm member 36 is moved in the direction of arrow to cause the first blade 35 to effect the removal of the liquid. Such removal of the liquid is effected by actuating the arm member 36 after the necessary toner image has passed the position of the blade 35. In the present embodiment, the stoppage of the photosensitive medium takes place after the blade 35 has been operated while the photosensitive medium has made substantially a complete rotation to have all the developing liquid thereon removed.

The embodiments of FIGS. 5 to 8 show a method of positively removing the liquid on an image-bearing member such as photosensitive medium or the like prior to such image-bearing member being stopped from rotating, whereby inadvertent evaporation of the liquid from the image-bearing member may be prevented even when the image-bearing member is in its stationary condition.

Figure 9:
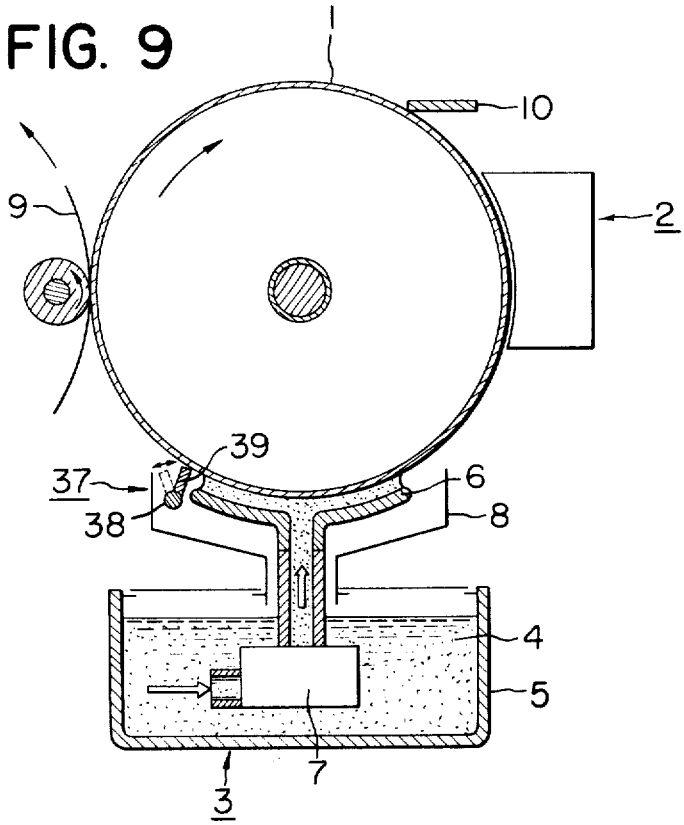

However, the method of preventing the evaporation of liquid according to the present invention is not restricted to the above-described first and second methods carried out individually, but may effectively be carried out with the first and second methods combined together as shown in FIG. 9. More specifically, as in the FIG. 1 embodiment, the rotation of the pump 7 is reversed or discontinued to thereby cut off the supply of the developing liquid to the photosensitive medium 1 while, at the same time, liquid removal means 37 using the blade 26 of FIG. 5 making contact with the photosensitive medium to remove the liquid therefrom may also be employed, thereby producing a greater effect. The liquid removal means 37 includes a blade 39 pivotable about a shaft 38. The blade 39, which assumes the phantom-line position during development, is pivoted to the solid-line position before the photosensitive medium 1 is stopped but at the same time that the contact between the photosensitive medium 1 and the developing liquid is cut off, and simultaneously therewith, removal of the developing liquid on the photosensitive medium 1 is effected. In this case, the quantity of the liquid on the photosensitive medium 1 is sharply decreased because of the discontinued supply thereof, so that the liquid removal efficiency is enhanced by the liquid removal means used in conjunction with the cut-off of the liquid supply.

In the various embodiments of the present invention hitherto described, the image-bearing member has been shown as a drum-shaped photosensitve medium and the evaporative liquid has been illustrated as developing liquid. By the present invention being thus applied to the developing means in the conventional copying apparatus, the quantity of carrier liquid to be supplied to supplement the developing liquid can be extremely reduced as compared with that required in the prior art. The present invention is applicable not only to the developing means but also to the cleaning means for cleaning the image-bearing member to remove the toner or other residual substances. More specifically, evaporative cleaning liquid may be applied to the image-bearing member for the cleaning thereof, and thereafter but before the image-bearing member is stopped, the cleaning liquid may be removed from the image-bearing member by the first or the second method or by a combination of the two methods. On the other hand, the image-bearing member is not restricted to the above-described photosensitive medium but may be a recording medium of insulative material having a latent image or a visualized image transferred thereto. The configuration of the image-bearing member may be that of a drum or a belt.

Thus, the present invention can prevent inadvertent evaporation of evaporative liquid on an image-bearing member and this is effective not only economically but also in maintenance of the image forming apparatus. For example, when applied to developing means, the present invention eliminates the evaporation of the developing liquid which would otherwise take place during the rest condition of the apparatus, and this also leads to the elimination of inadvertent loss of the developing liquid as well as improved efficiency of cleaning. Further, the present invention overcomes or eliminates the above-noted technical problems and disadvantages peculiar to the prior art, thus achieving its intended purposes.

What is claimed is:

1. A method for preventing evaporation of evaporative liquid from an endless surface of a rotatable member wherein said surface bears an electrostatic latent image or a visualized image, and wherein means are provided for supplying evaporative liquid to said surface and for removing evaporative liquid from said surface, said supplying means and said removing means being circumferentially spaced along said endless surface, said method comprising the steps of removing all evaporative liquid from said surface between said supplying means and said removing means and then stopping the rotation of said rotatable member, whereby no evaporative liquid remains on the surface of said rotatable member when said member is stopped.

2. A method for preventing evaporation of evaporative liquid from an endless surface of a rotatable member wherein said surface bears an electrostatic latent image or a visualized image, and wherein means are provided for supplying evaporative liquid to said surface and for removing evaporative liquid from said surface, said supplying means and said removing means being circumferentially spaced along said endless surface, said method comprising the steps of terminating contact between the evaporative liquid from said supplying means and said surface, rotating said member at last until all the evaporative liquid on said surface between said supplying means and said removing means has been removed by said removing means, and then stopping the rotation of said rotatable member, whereby no evaporative liquid remains on the surface of said rotatable member when said member is stopped.

3. A method according to claim 2, wherein said rotatable member and said supplying means are moved relative to one another to terminate contact between the evaporative liquid from said supplying means and said surface.

4. A method according to claim 2, wherein the flow of evaporative liquid to said supplying means is stopped in order to terminate contact between the evaporative liquid from said supplying means and said surface.

5. A method for preventing evaporation of evaporative liquid from an endless surface of a rotatable member wherein said surface bears an electrostatic latent image or a visualized image, and wherein means are provided for supplying evaporative liquid to said surface and for removing evaporative liquid from said surface, said supplying means and said removing means being circumferentially spaced along said endless surface, said method comprising the steps of positively removing the evaporative liquid applied to said surface at a location adjacent to said supplying means, rotating said member at least until all the evaporative liquid on said surface between said supplying means and said removing means has been removed by said removing means and then stopping the rotation of said rotatable member, whereby no evaporative liquid remains on the surface of said rotatable member when said member is stopped.

6. A method according to claim 5, wherein a frictionally slidable member is slid into contact with said surface to positively remove the evaporative liquid adjacent to said supplying means.

7. A method according to claim 5, wherein compressed air is directed against said surface to positively remove the evaporative liquid adjacent to said supplying means.

8. A method according to claim 5, wherein a further rotatable member is brought into contact with said surface to positively remove the evaporative liquid adjacent to said supplying means.

9. A method according to claim 5, wherein a frictionally slidable member is slid into contact with said surface to positively remove the evaporative liquid adjacent to said supplying means, said frictionally slidable member being interconnected with said removing means so that when said frictionally slidable member contacts said surface, said removing means is moved to an inoperative position.

10. A method for preventing evaporation of evaporative liquid from an endless surface of a rotatable member wherein said surface bears an electrostatic latent image or a visualized image, and wherein means are provided for supplying evaporative liquid to said surface and for removing evaporative liquid from said surface, said supplying means and said removing means being circumferentially spaced along said endless surface, said method comprising the steps of positively removing the evaporative liquid applied to said surface at a location adjacent to said supplying means, terminating contact between the evaporative liquid from said supplying means and said surface, rotating said member at least until all the evaporative liquid between said supplying means and said removing means has been removed by said removing means, and then stopping the rotation of said rotatable member, whereby no evaporative liquid is left on the surface of said rotatable member when said member is stopped.

* * * * *